US006827323B2

(12) United States Patent
Minemoto

(10) Patent No.: US 6,827,323 B2
(45) Date of Patent: Dec. 7, 2004

(54) MOLD COOLING DEVICE

(75) Inventor: Masayuki Minemoto, Ikeda (JP)

(73) Assignee: J.F.T. Co., Ltd., Osaka (JP)

( * ) Notice: Subject to any disclaimer, the term of this patent is extended or adjusted under 35 U.S.C. 154(b) by 166 days.

(21) Appl. No.: 10/070,869

(22) PCT Filed: Sep. 17, 2001

(86) PCT No.: PCT/JP01/08082

§ 371 (c)(1),
(2), (4) Date: Jun. 25, 2002

(87) PCT Pub. No.: WO02/24376

PCT Pub. Date: Mar. 28, 2002

(65) Prior Publication Data

US 2002/0182281 A1 Dec. 5, 2002

(30) Foreign Application Priority Data

Sep. 25, 2000 (JP) ..... 2000-290808
Sep. 11, 2001 (JP) ..... 2001-275426
Sep. 11, 2001 (JP) ..... 2001-275468

(51) Int. Cl.[7] ..... B22C 9/06; B22D 17/22

(52) U.S. Cl. ..... 249/79; 249/205; 425/552; 164/348

(58) Field of Search ..... 249/79, 205; 425/552; 164/126, 128, 348

(56) References Cited

U.S. PATENT DOCUMENTS 4,275,864 A * 6/1981 Richards ..... 249/79
4,655,280 A * 4/1987 Takahashi ..... 165/47
5,285,841 A * 2/1994 Yamauchi et al. ..... 164/348

FOREIGN PATENT DOCUMENTS

| | | |
|---|---|---|
| JP | 60-072641 | 4/1985 |
| JP | 63-004085 | 1/1988 |
| JP | 02-123354 | 10/1990 |
| JP | 05/220562 | 8/1993 |
| JP | 06-285863 | 10/1994 |
| JP | 07-052161 | 2/1995 |
| JP | 2001-275468 | 7/1995 |
| JP | 08-243713 | 9/1996 |
| JP | 10-080758 | 3/1998 |
| JP | 2000-071056 | 3/2000 |
| JP | 2002-172455 | 6/2002 |
| JP | 2002-239683 | 8/2002 |

OTHER PUBLICATIONS

Computer translation of Japanese Pub. No. 10–080758.*

* cited by examiner

*Primary Examiner*—James P. Mackey
*Assistant Examiner*—Donald Heckenberg
(74) *Attorney, Agent, or Firm*—J.C. Patents

(57) ABSTRACT

A mold cooling device includes an air feeding and discharging circuit 22 which effects the driving by air of a pump section 1 for feeding a cooling liquid to a fluid flaw passageway 65*a* fanned in a mold 64 and the feeding of air to the fluid flow passageway 65*a*. Letting (Dx) be the outer diameter-corresponding dimension of the holed convex portion 53*x* of a cast article 64*x*, (D1) be the outer diameter of the pin section 65 of the mold 64, (t1) be the outer peripheral thickness of the pin section 65, and (T1) be $-5.103+(0.621\times D_x)-(1.068\times D1)+(3.61\times t1)$, the time (T) for feeding cooling liquid to the fluid flow passageway 65*a* after completion of the pouring of molten metal into the mold 64 is set so that the relation T1-0.5 seconds $\leqq T \leqq T1\times 0.5$ seconds is satisfied.

13 Claims, 9 Drawing Sheets

MOLD COOLING DEVICE

BACKGROUND OF THE INVENTION

The present invention relates to a cooling device for molds used in die casting or the like and particularly it relates to a technique for efficiently feeding fluid to a fluid flow passageway for cooling formed in a mold.

As well known, in the case of a mold used for die casting or the like, in order to form a hole in a predetermine place in a cast article, a pin section, such as a core pin, is inserted in a predetermined place in a cavity formed in the mold. It is common practice to attach a cooling device to this kind of mold for cooling said pin section.

Such cooling device comprises a fluid flow passageway formed in a pin section, a pump section for feeding cooling liquid from a liquid source to said fluid flow passageway, and a fluid feeding and discharging circuit for driving said pump section. In this case, the fluid flow passageway of said pin section is constructed such that, as shown in FIG. 9, the pin section 91 of a mold 90 is formed with a bottom-closed cooling hole 93 having spherical bottom surface 92 in the front end, positioned in said bottom-closed cooling hole 93 are the respective front end openings in concentrically disposed inner and outer pipes 94 and 95. The front end opening in the inner pipe 94 is disposed in opposed closely adjacent relationship to said bottom surface 92 than the front end opening in the outer pipe 95, in opposed relationship thereto, and a fluid flow passageway 91*a* is constructed so that the inner passageway 96 of the inner pipe 94 serves as a forward passageway for the cooling water while a between-pipe passageway 97 between the inner and outer pipes 94 and 95 serves a backward passageway for the cooling water. And, in performing the casting operation, the cooling liquid is fed to the fluid flow passageway 91*a* of the pin section 91 after the completion of the poring of molten metal into the cavity portion 98, and at the time when the molten metal has solidified and cooled to a suitable degree, the mold is opened to take out the cast article.

In this case, if the cooling liquid remains in the fluid flow passageway 91*a* of the pin section 91 when one lot of cast articles are produced upon the termination of the preceding casting operation, not only troubles occur in performing the subsequent casting operation but also it presents a cause of corrosion occurring in the fluid flow passageway 91*a*. Therefore, upon termination of casting operation for each lot is applied the so-called air purge in which air is fed under pressure to the fluid flow passageway 91*a* for a very short time to discharge the cooling liquid out of the fluid flow passageway 91*a* of the pin section 91 into the outside.

Further, this kind of pump section of the cooling device is of the so-called single-acting type in which the cooling liquid is fed only when the piston reciprocably held in the cylinder chamber moves in one way; therefore, usually the cooling liquid is intermittently fed to the fluid flow passageway 91*a* of the piston portion 91.

In the method of intermittently feeding the cooling liquid by using a single-acting pump as described above, however, it is difficult to feed a large amount of cooling liquid under uniform pressure continuously to the fluid flow passageway 91*a* of the pin section 91, so that in cooling the cast article, the quickening of application or stoppage of cooling action is hindered, leading to degradation of response. Further, such method only makes it advantageous to execute batch processing, and effecting batch processing according to this method would produce problems including one of increasing the size of the pump section or the fluid feeding and discharging circuit including the cooling liquid source, thus incurring the soaring of the cooling device costs.

Further, conventionally, to increase the pump performance, the pump section is driven by using oil pressure. Such method, however, requires not only the cooling liquid feeding and discharging circuit for feeding the cooling liquid to the pin section 91 but also an oil pressure feeding and discharging circuit including an oil pressure source for driving the pump section, and an air feeding and discharging circuit including an air source for applying air purge to the fluid flow passageway 91*a* of the pin section 91, thus incurring an increase in the size of the cooling device and the soaring of its costs.

Further, the temperature control of the outer surface of the pump section 91 (and the inner surface of the hole in a cast article) during molding according to the conventional method, actually, is effected depending on the cooling liquid alone which is fed to the fluid flow passageway of the pin section. And, if the termination temperature of the outer surface of this pin section 91 is too high, a release agent which is to be applied to the outer surface of the pin section 91 so as to execute the subsequent is repelled on the outer surface, making it impossible to apply a suitable amount of release agent. Further, if the termination temperature of the outer surface of this pin section 91 is too low, such release agent will flow down and fails to stick, so that in this case also it becomes impossible to apply a suitable amount of release agent.

Therefore, the termination temperature of the outer surface of the pin section 91 is very important in making high-quality cast articles; however, conventionally, since the temperature control thereof has been dependent on the feeding of the cooling liquid, as described above, it has been considered very difficult to stabilize the outer surface of the pin section 91 at a suitable termination temperature.

On the other hand, the cooling water flowing from the inner passageway 96 of the pipe 94 shown in FIG. 9 into the bottom-closed cooling hole 93 collides with the bottom surface 92 to change its direction of flow, then passing through a cooling hole inner passageway 99 existing on the outer periphery side of the inner pipe 94 into a between-pipe passageway 97 between the two pipes 94 and 96, then flowing out of the between-pipe passageway 97.

In this case, the bottom-closed cooling hole 93 formed in the pin section 91 of the conventional mold 90, as shown in the same figure, has a central region, with an axis (X) in the bottom surface 92 used as a reference, which forms a spherical surface 92*x*, with the outer peripheral region thereof usually forming a tapered conical surface 92*y*.

However, with the central region of the bottom surface 92 thus forming the spherical surface 92*x*, if the cooling water from the inner pipe 94 change its direction of flow as it collides with the spherical surface 92*x*, the cooling water after its change of direction has produced therein a flow component which tends to converge in the vicinity of the center of the spherical surface 92*x* (in the vicinity of the axis (X)), said flow component flowing in the direction opposite to the flow of cooling water from the inner pipe 94 and colliding therewith. Therefore, obstruction to passage of the cooling water takes place in the vicinity of the bottom surface 92 of the bottom-closed cooling hole 93, thus causing the stagnation of cooling water. As a result, smooth outflow of cooling water is obstructed and since the lack of cooling action causes the mold 90 (core pin 91) to become heated to high temperature, there occurs an imperfection that a diecast article (for example, aluminum cast article) becomes partly fused to the mold 90.

Furthermore, the outer peripheral region of the bottom surface 92 being the tapered conical surface 92*y* results in a flow component which tends to converge in the vicinity of the axis (X) being produced in the cooling water which has changed its direction of flow as it collides with said conical surface 92*y*, said flow component flowing in the direction opposite to the flow of the cooling water from the inner pipe 94 to collide with said cooling water; therefore, the obstruction to passage of cooling water described above and the fusion of the diecast article to the mold 90 owing to said obstruction become more conspicuous.

Further, conventionally, the dimension (S) of the spacing between the bottom surface 92 of the bottom-closed cooling hole 93 and the front end of the inner pipe 94 is set usually about 10 times or more the inner diameter (d) of the inner pipe 94; more specifically, the spacing dimension (S) is usually set at 10 mm or more.

However, according to such setting, said spacing dimension (S) becomes longer than is necessary, so that the cooling water delivered from the inner pipe 94 decreases in flow rate before it collides with the bottom surface 92, so that it could flow out of the between-pipe passageway 97 as it rides on another flow of cooling water at a position short of the bottom surface 92. Therefore, this also causes an obstruction to passage of cooling water in the vicinity of the bottom surface 92, resulting in the stagnation of cooling water; therefore, smooth outflow of cooling water is obstructed in the same manner as described above, forming a main cause of fusion of the diecast article to the mold 90.

SUMMARY OF THE INVENTION

An object of the invention is to provide an arrangement wherein while reducing the size and weight of the mold cooling device, the response to the feeding and stoppage of cooling liquid is improved, thereby ensuring a satisfactory cooling action, so as to allow the termination temperature of the mold (particularly, the outer surface of the pin portion) to become efficiently stabilized at an optimum value.

Another object of the invention is to provide an arrangement wherein the shape around the bottom surface of the bottom-closed cooling hole in the mold, or the positional relationship between the bottom surface and the inner pipe is improved, thereby avoiding interference with passage of cooling liquid which occurs in the vicinity of the bottom surface of the bottom-closed cooling hole, ensuring satisfactory cooling action.

The present invention, which has been accomplished in order to achieve said objects, provides a mold cooling device having a pump section for feeding a cooling liquid to a fluid flow passageway formed in a mold, comprising an air feeding and discharging circuit which effects the driving of said pump section by air and the feeding of air to said fluid flow passageway, the arrangement being such that the cooling liquid can be continuously fed from said pump section to said fluid flow passageway. According to such arrangement, since the driving of the pump section is effected by air, the air feeding and discharging circuit for driving the pump section and the air feeding and discharging circuit for feeding air to the fluid flow passageway of the mold can be integrated, making it possible to use, for example, a single air source and a single main air passageway leading thereto. This eliminates the need for providing fluid feeding and discharging circuits of separate systems for driving the pump section and for feeding air to the mold, as in the case of driving the pump section by oil pressure, so that it becomes possible to make the fluid feeding and discharging circuit compact in size and hence to reduce the cost of the mold cooling device. Furthermore, since the pump section is capable of continuously feeding cooling liquid to the fluid flow passageway of the mold, it becomes possible to store, all the time and a little short of the fluid flow passageway (or on the upstream side), cooling liquid which is held under predetermined pressure as by a pressure adjusting valve. This eliminates the possibility of lack of cooling liquid, non-uniform liquid pressure, or the like occurring as when the cooling liquid is intermittently fed, thus ensuring a satisfactory response with which the execution or stoppage of the feeding of cooling liquid to the fluid flow passageway is effected. Further, according to such method of continuously feeding cooling liquid, there is no need for the pump section to have the power to feed a large amount of cooling liquid at one stroke; therefore, it becomes possible to achieve reduction of the size and weight of the pump section and hence to make compact in size the cooling liquid feeding and discharging circuit including the liquid source.

The concrete construction of said pump section comprises a first cylinder chamber and a second cylinder chamber which are coaxially arranged in series, a first piston and a second piston which are disposed in said first and second cylinder chambers, respectively, and a piston rod for connecting said two pistons to each other, wherein during both periods of forward and backward movements of both said pistons attending on the feeding and discharging of air to and from said first cylinder chamber, the cooling liquid is fed from said second cylinder chamber to the fluid flow passageway of said mold. With such arrangement, during not only the forward movement but also the backward movement of the piston, cooling liquid is fed to the fluid flow passageway of the mold, and since such feeding operation is continuously effected, no loss is involved in the feeding of cooling liquid. To describe in more detail, as compared with the case where cooling liquid is intermittently fed only during the forward movement of the piston, it becomes possible to feed about twice the amount of cooling liquid to the mold per reciprocation of the piston. Therefore, it becomes possible to feed a sufficient amount of cooling liquid without increasing the size of the pump section, and the cooling action is efficiently applied to the mold.

And, it is suitable to arrange that said mold be designed to form the holed convex portion of a cast article between the pin section having said fluid flow passageway formed therein and the cavity portion surrounding the outer periphery of said pin section, and that the temperature adjustment of the outer surface of said pin section and the hole inner surface of the holed convex portion contacting the same is made on the basis of (1) the feeding of cooling liquid to said fluid flow passageway and (2) the recuperative action which is consequent on the feeding of air to said fluid flow passageway immediately after stoppage of said feeding of cooling liquid. The term "holed convex portion" refers to a convex portion formed with a hole as in a boss portion; however, this holed convex portion may be a bulging portion which is convex in the direction of the center axis of the hole or it may be an overhanging portion which is convex in a direction orthogonal to the center axis of the hole. And, the peripheral portion of the holed convex portion is formed by the cavity portion, and the hole is formed by the pin section. With such arrangement, the molten metal poured into the cavity portion during execution of the casting operation undergoes temperature drop at its surface of contact with the pin section, i.e., at the hole inner surface, owing to the cooling fluid fed to the fluid flow passageway in the pin section, and the outer surface of the pin section also undergoes temperature drop with substantially the same gradient as that for the first-mentioned temperature drop. At this stage, the outer surface temperature of the pin section is lower than that of the hole inner surface of the holed convex portion with a substantial temperature difference. And, the feeding of cooling liquid is stopped upon lapse of a predetermined time to be later described and immediately thereafter air is fed to the fluid flow passageway in the pin section. In the case where air is fed in this manner, the recuperative action of air raises the outer surface temperature of the pin section until it is substantially equal to the hole inner surface temperature of the holed convex portion, whereupon even when time elapses, both temperatures are stabilized at a substantially fixed temperature owing to said recuperative action. That is, the recuperative action of air prevents a drop in the hole inner surface temperature of the holed convex portion, and this hole inner surface temperature and the outer surface temperature of the pin section which has become substantially equal thereto settle on a substantially fixed value, whereupon even when time elapses, no difference hardly occurs between these temperatures. This makes efficient and appropriate temperature control possible about the outer surface temperature of the pin section and the hole inner surface temperature of the holed convex portion.

In this case, concerning the feeding of cooling liquid to the fluid flow passageway in said pin section, it is desirable that letting (Dx) be the outer diameter-corresponding dimension of the holed convex portion of said cast article, (D1) be the outer diameter of said pin section, (t1) be the outer peripheral thickness of said pin section, and (T1) be $-5.103+(0.621\times Dx)-(1.068\times D1)+(3.61\times t1)$, the time (T) for feeding cooling liquid to the fluid flow passageway after completion of the pouring of molten metal into said mold be set so that the relation $T1-0.5$ seconds $\leqq T \leqq T1+0.5$ seconds is satisfied. In addition, the time for starting the feeding of cooling liquid is suitably 0.3–0.7 second, preferably about 0.5 second after the start of the pouring of molten metal into the mold. As for the term "outer diameter-corresponding dimension," if the holed convex portion is cylindrical or partially cylindrical, the outer diameter of an imagined complete cylinder is the outer diameter-corresponding dimension, or if the outer shells of the axis-perpendicular section of the holed convex portion is not of true circle, such as a rectangle, polygon or ellipse, the outer diameter of an imagined cylinder having the same axis-perpendicular sectional area as that of the wall portion of the holed convex portion is the outer diameter-corresponding dimension. Judging from the above formula, it can be seen that the time (T1) serving as an index for the cooling liquid feeding time becomes longer as the outer diameter-corresponding dimension (Dx) of the holed convex portion increases, that it becomes shorter as the outer diameter (D1) of the pin section, that is, the inner diameter of the hole of the holed convex portion increases, and that it becomes longer as the outer peripheral wall thickness (t1) of the pin section increases. In the formula, the individual numerical values −5.103, 0.621, 1.068 and 3.61 are values obtained by us conducting experiments on feeding cooling liquid and air many times with respect to many kinds of holed convex portions having (Dx) and many kinds of pin sections having (D1) and (t1), sampling cooling liquid feeding times with respect to all cases of said many kinds so as to find a high-quality holed convex portion and a temperature which is optimum for the outer surface of the pin section to have a releasing agent to be later described applied thereto, and performing predetermined calculations on the basis of such cooling liquid feeding times and respective values of (Dx), (D1) and (t1). In compliance with this formula, we have calculated the time (T1) serving as an index for cooling liquid feed, and conducted experiments on feeding cooling liquid for said time (T1) and then feeding air immediately thereafter, many times with respect to cases of many kinds different in conditions from those mentioned above. As a result, it has been found that at any rate, high-quality holed concave portions are obtained and, at the same time, that a releasing agent can be properly applied to the outer surface of the pin section. The experiments have also revealed that if the time is within the range of this time (T1), serving as an index, ±0.5 seconds, a holed convex portion equivalent to the above can be obtained and that the applicability for a releasing agent to the outer surface of a pin section equivalent to the above can be obtained. Therefore, although the time (T) for feeding cooling liquid to the fluid flow passageway in the pin section is optimum when T=T1, satisfying the relation $T1-0.5$ seconds $\leqq T \leqq T1+0.5$ seconds provides good quality of cast articles and allows the casting operation to proceed smoothly without trouble.

Further, as for the feeding of air, it is preferable that air be fed to said fluid flow passageway for 5 seconds or more immediately after the stoppage of the feeding of cooling liquid to said fluid flow passageway. That is, if the feeding of air is effected for less than 5 seconds, sufficient recuperative action is not obtained, resulting in the outer surface temperature of the pin section and the hole inner surface temperature of the holed convex portion failing to assume a stabilized state in which they have a substantially fixed value, thus incurring the possibility of variations occurring between the two temperatures. Therefore, if the feeding of air is maintained for 5 seconds or more, said two temperatures can be stabilized at a substantially fixed value even if variations occur in the mold opening time after completion of the casting operation or even if the time interval from the completion of the preceding casting operation to the start of the subsequent casting operation is long. Considering that if this air feeding time becomes excessively long, it becomes impossible to stably maintain said two temperatures at a substantially fixed value, it has been decided that said air feeding time be 15 seconds or less, preferably about 10 seconds.

And, it is suitable to allow the outer surface temperature of said pin section to terminate in a temperature range of 200–250° C. by feeding air to said fluid flow passageway. In the case where the outer surface temperature of the pin section is terminated in such range, the hole inner surface temperature of the holed convex portion also inevitably terminates in the temperature range of 200–250° C. This allows a suitable amount of releasing agent, which consists of a viscous fluid, to be reliably applied to the outer surface of the pin section prior to the start of the subsequent casting operation after completion of the preceding casting operation. In this case, if the outer surface temperature of the pin section is less than 200° C., then most of the releasing agent flow down from the outer surface of the pin section, with the releasing agent failing to spread well over the outer surface of the pin section, while if the outer surface temperature of the pin section is exceeds 250° C., then most of the releasing agent is repelled from the outer surface temperature of the pin section, in which case also, the releasing agent fails to spread well over the outer surface of the pin section.

Further, it is preferable that in the passageway for discharge of air from the fluid flow passageway in said pin portion, an opening/closing valve be installed for opening/closing said discharge passageway. This makes it possible to know whether there is leakage of air from the fluid flow passageway, that is, whether there is damage, such as cracks, in the pin section, because when the casting operation is over, more specifically, after the outer surface temperature of the pin section and the hole inner surface temperature have become stabilized within the range of 200–250° C. with air being fed to the fluid flow passageway for 5 seconds or more, the opening/closing valve closes the air discharge passageway while the feeding of air is maintained. That is, the pin section is subjected to repetition of the influence of temperature changes between high and low temperature conditions, which means that performing the casting operation many times causes damage, such as cracks; it is preferable that the pin section be replaced in early stages of generation of damage, that is, at a stage where leakage of cooling liquid from the fluid flow passageway will not cause deterioration of the quality of the cast article. Therefore, replacing the pin section on first detection of leakage of air when the casting operation is over will increase the yield of product. In addition, as for the time for closing the opening/closing valve, it may be closed each time 1 lot of casting operation is performed or preferably once every several lots of casting operation. Further, the detection of air can be made through the sense of vision or auditory sense of the human being or preferably by using a pressure detecting means (for example, a pressure gauge or a pressure switch) installed in the passageway leading to the fluid flow passageway in the pin section.

Further, preferably said fluid flow passageway is constructed in such a manner that concentrically arranged inner and outer pipes are connected to a bottom-closed cooling hole, which is formed in the mold to have a bottom surface on the front end, so that the front end opening in the inner pipe lies closer to said bottom surface than does the front end opening in the outer pipe, the inner passageway of said inner pipe serving as a forward passageway for cooling liquid, the between-pipe passageway between both said pipes serving as a backward passageway for cooling liquid, the central region of the bottom surface of said bottom-closed cooling hole being formed with a flat surface portion, whose outer peripheral region is formed with a curved surface portion which continuously extends from said flat surface portion to the inner peripheral surface of the bottom-closed cooling hole. With this arrangement, in the case where the cooling liquid delivered from the inner pipe collides with the flat surface formed in the central region of the bottom surface of the bottom-closed cooling hole to change its direction of flow, there is no possibility of a flow component being produced which tends to converge in the axial portion as in the prior art; rather, a large amount of flow component is produced which tends to diverge toward the outer periphery. Owing to this, a large amount of cooling liquid flows along the bottom surface toward the outer periphery, then smoothly changing its direction in the curved portion of the peripheral region, flowing along the inner peripheral surface of the bottom-closed cooling hole in parallel with the axis and away from the bottom surface, finally flowing out through the between-pipe passageway. And, in the bottom-closed cooling hole, since the flow of cooling liquid as described above is the mainstream, interference with passage of the cooling liquid or consequent stagnation hardly occurs in the vicinity of the bottom surface. This ensures smooth passage of cooling liquid and sufficient cooling action, thereby effectively avoiding drawbacks including the welding of the diecast article to the mold.

In this case, the diameter of said flat surface portion is set at a value preferably larger than the inner diameter of said inner pipe, and more preferably the diameter of said flat surface portion is set at about 1.5–3.0 times the inner diameter of said inner pipe. With such setting, a sufficient distance over which the cooling liquid delivered from the inner pipe flows along the bottom surface toward the outer periphery can be obtained to allow the cooling liquid to reach the curved surface portion while maintaining a suitable degree of flow rate; thus, it is possible to obtain suitable passability for the cooling liquid. In addition, if the diameter of said flat surface portion is less than 1.5 times the inner diameter of the inner pipe, it may become impossible to suitably secure the distance over which the cooling fluid flows along the bottom surface toward the outer periphery. Reversely, if it exceeds 3.0 times, there increases the amount of component which stalls and changes its direction during the time the cooling liquid reaches the curved surface portion from the flat surface portion, incurring the possibility of stagnation being generated in the vicinity of the curved surface portion.

Further, it is preferable that said curved surface portion exhibit a substantially arcuate shape in its axis-containing section. Herein, the term "axis-containing section" means a section which contains the axis, and more specifically, it means a section which is cut along the axis. With this arrangement, when the cooling liquid, which has flowed along the bottom surface toward the outer periphery, changes its direction in the curved surface portion to flow away from the bottom surface, interference with passage of flow or flow resistance increase can be minimized, so that the change of direction of the cooling liquid can be made in an optimum state.

Further, it is preferable that the spacing dimension between the bottom of said bottom-closed cooling hole and the front end of said inner pipe be set at 5 times or less the inner diameter of the inner pipe. In addition, this spacing dimension is 3 times or less, preferably twice or less the inner diameter of the inner pipe. With this arrangement, the spacing dimension between the bottom surface of the bottom-closed cooling hole and the front end of the inner pipe becomes shorter than in the prior art in relation to the inner diameter of the inner pipe, thus allowing the cooling liquid delivered from the inner pipe to reach the bottom surface of the bottom-closed cooling hole without involving lack of flow rate. This results in subsequent fresh portions of cooling liquid colliding with the bottom surface all the time, minimizing the stagnation of the cooling liquid in the vicinity of the bottom surface, ensuring sufficient cooling action, thereby effectively avoiding drawbacks including the welding of the diecast article to the mold due to lack of cooling. If the spacing dimension exceeds 5 times the inner diameter of the inner pipe, there is a danger of causing stagnation of the cooling liquid in the vicinity of the bottom surface, as in the prior art. And, setting this spacing dimension at 3 times or less, or twice or less the inner diameter of the inner pipe makes it possible to further reduce the probability of occurrence of said stagnation. In any case, said spacing dimension is preferably 1 time or more the inner diameter of the inner pipe. This is because if it is less than 1 time, the clearance between the front end opening in the inner pipe and the bottom surface is too small, decreasing the flow channel area for the cooling liquid just delivered from the inner pipe, incurring the danger of increasing the resistance to passage.

Further, the spacing dimension is set at preferably 2.0–5.0 mm, more preferably 2.5–3.0 mm. That is, if the spacing dimension is less than 2 mm (or less than 2.5 mm), the flow channel area for the cooling liquid just delivered from the inner pipe becomes small, incurring the danger of increasing the resistance to passage. On the other hand, if it exceeds 5.0 mm (or 3.0 mm), the flow rate decreases during the time taken for the cooling liquid delivered from the inner pipe to reach the bottom surface, incurring the possibility of making it difficult for the subsequent fresh portion of the cooling fluid to be fed to the vicinity of the bottom surface.

Further, it is preferable that the flow channel area of the cooling hole inner passageway formed between the inner peripheral surface of said bottom-closed cooling hole and the outer peripheral surface of said inner pipe beset at 1.5–2 times the flow channel area of said inner pipe. With this arrangement, since the flow channel area of the cooling hole inner passageway is larger than the flow channel area of the inner pipe, the resistance to the outflow of the cooling liquid (drain resistance) for the cooling liquid delivered from the inner pipe and having its flow direction changed at the bottom surface does not become too large. Furthermore, since the flow channel area of the cooling hole inner passageway is about 1.5–2 times the flow channel area of the cooling hole inner passageway, there is no possibility that the flow rate of the cooling liquid passing through the cooling hole inner passageway excessively decreases. And, if the flow channel area of the cooling hole inner passageway is less than 1.5 times the flow channel area of the inner pipe, the outflow resistance for the cooling liquid increases, interfering with the general passage of the cooling liquid and if it exceeds 2 times, the flow rate of the cooling liquid which is flowing out decreases, also interfering with the general passage of the cooling liquid.

DESCRIPTION OF THE PREFERRED EMBODIMENTS

Figure 1:
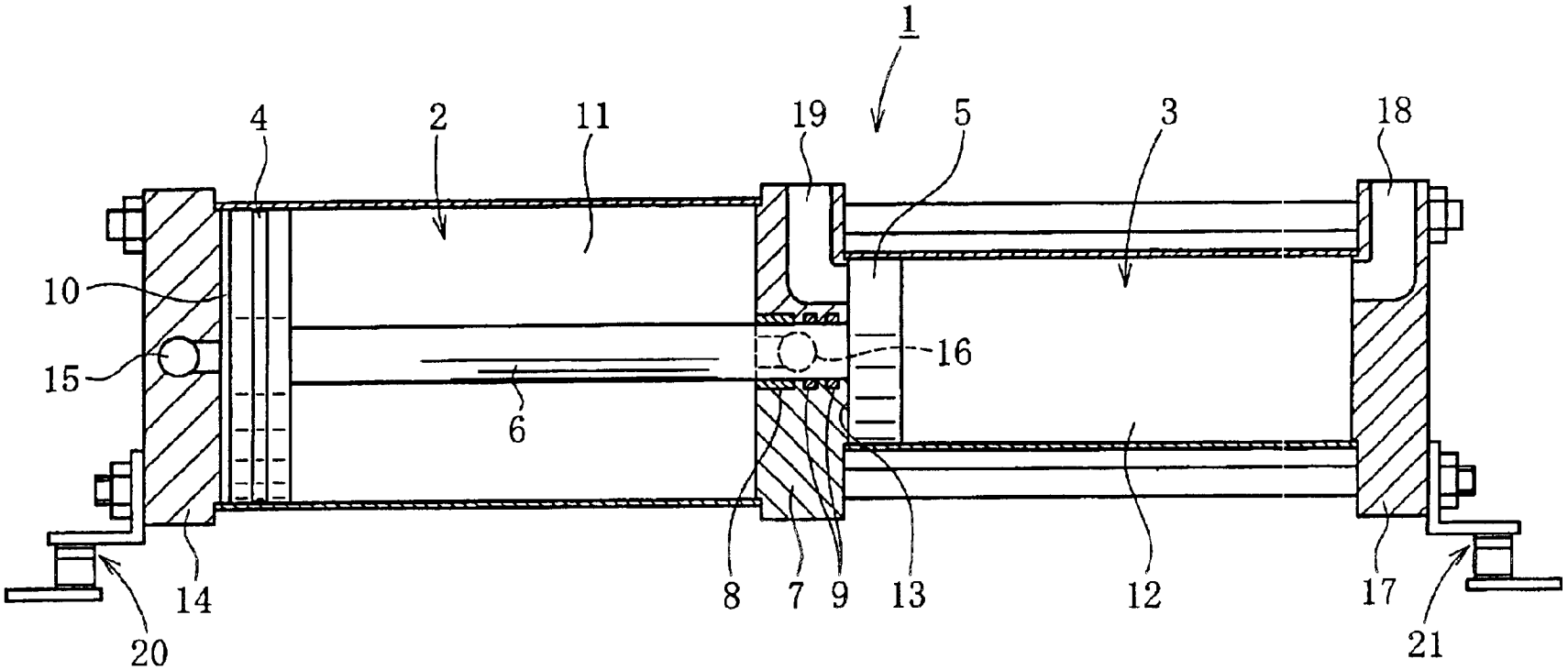
FIG. 1 is a front view, in longitudinal section, showing the pump section of a mold cooling device according to a first embodiment of the invention.
Figure 2:
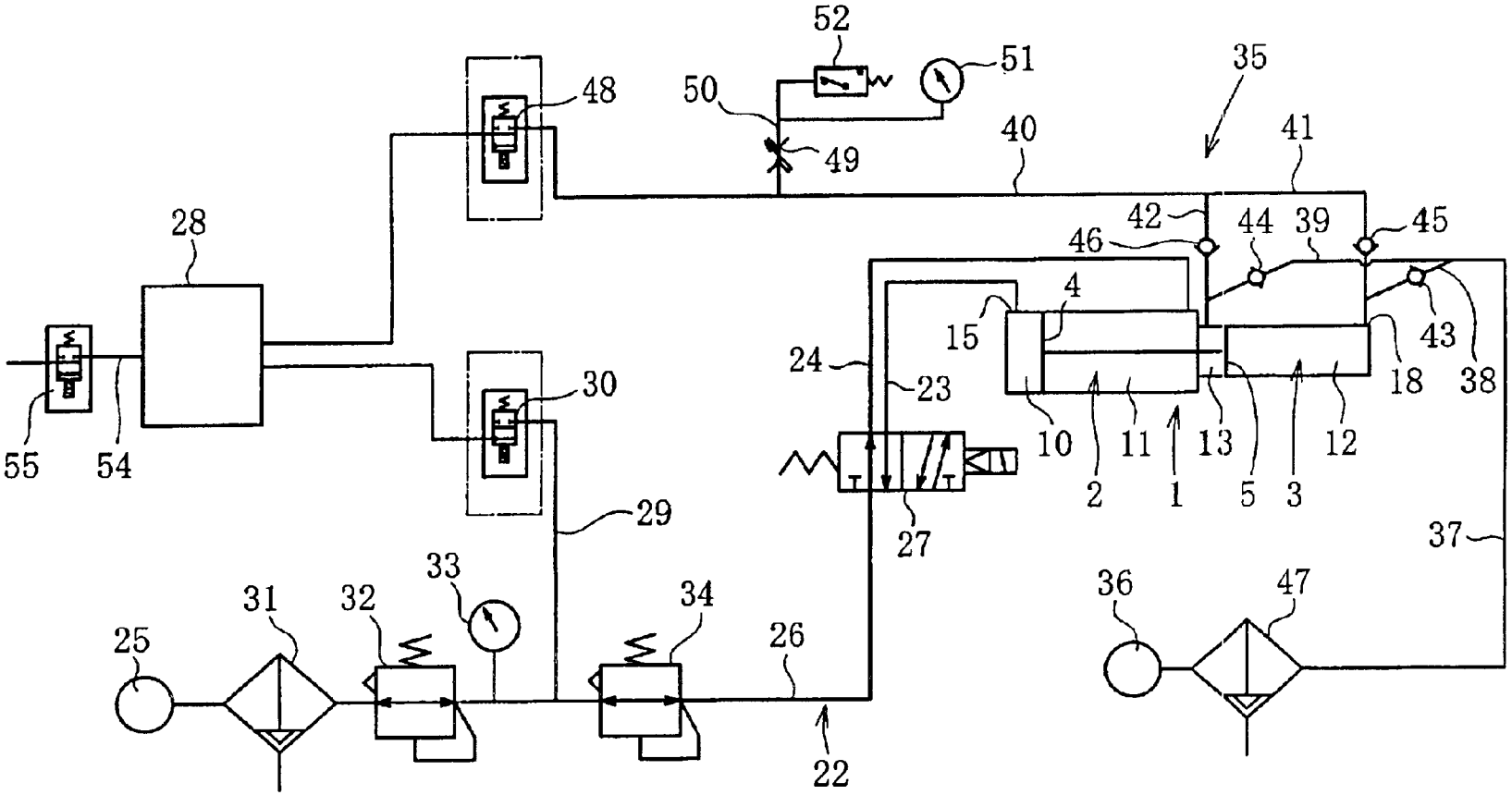
FIG. 2 is a circuit diagram showing an air feeding and discharging circuit and a cooling liquid feeding and discharging circuit for the mold cooling device according to the first embodiment of the invention.
Figure 3:
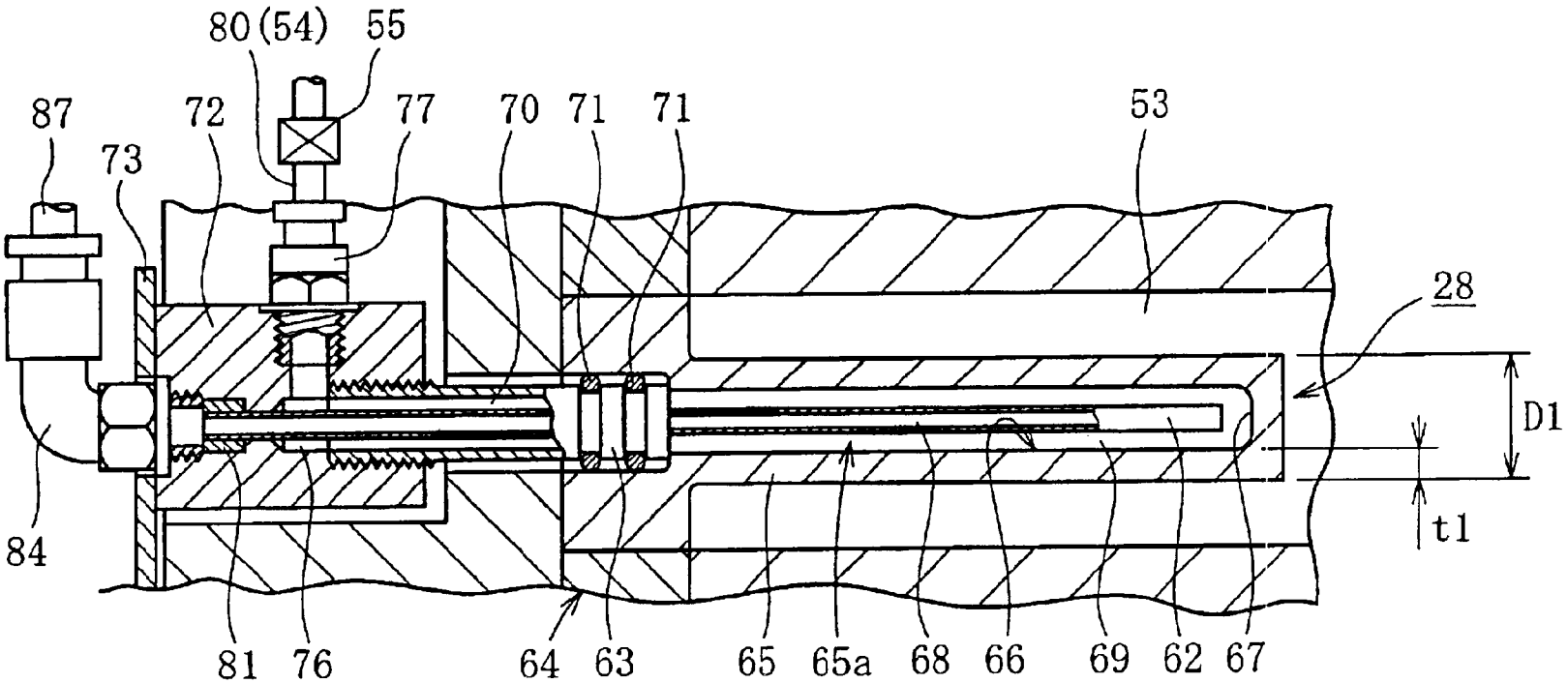
FIG. 3 is a sectional view showing the peripheral region around a fluid flow passageway in the mold.
Figure 4:
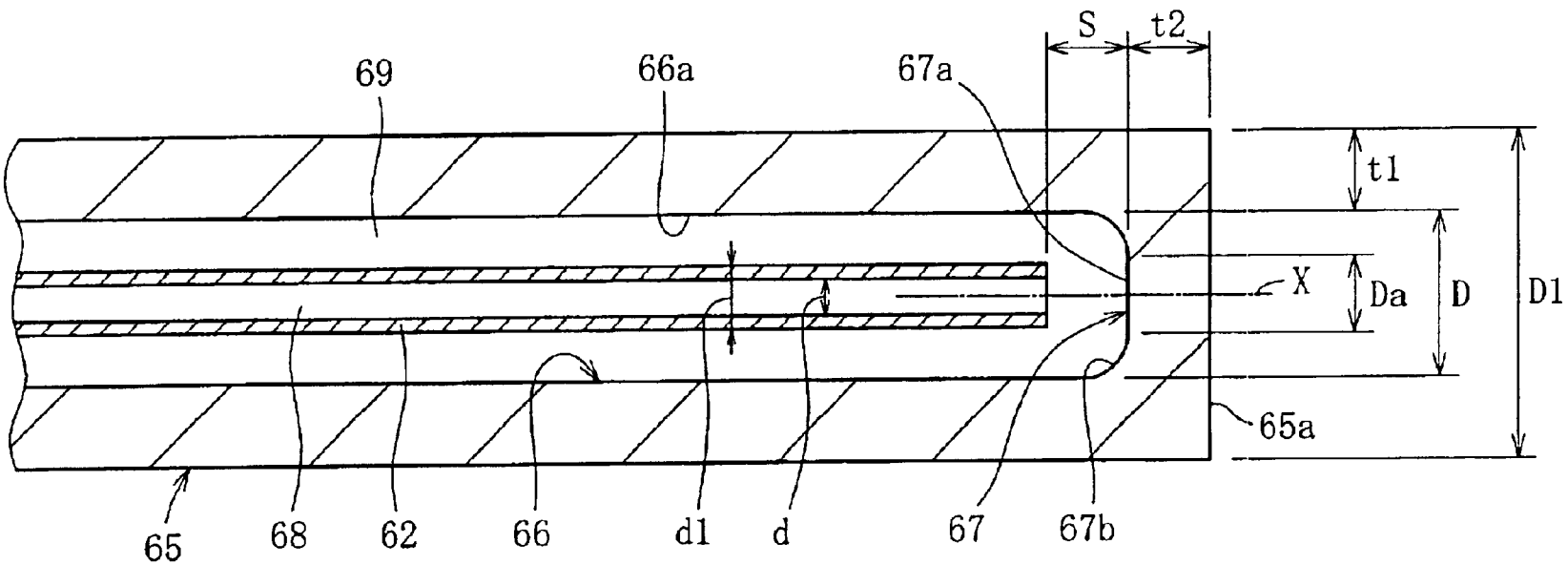
FIG. 4 is an enlarged sectional view showing the peripheral region around the front end of the fluid flow passageway in the mold.
Figure 5:
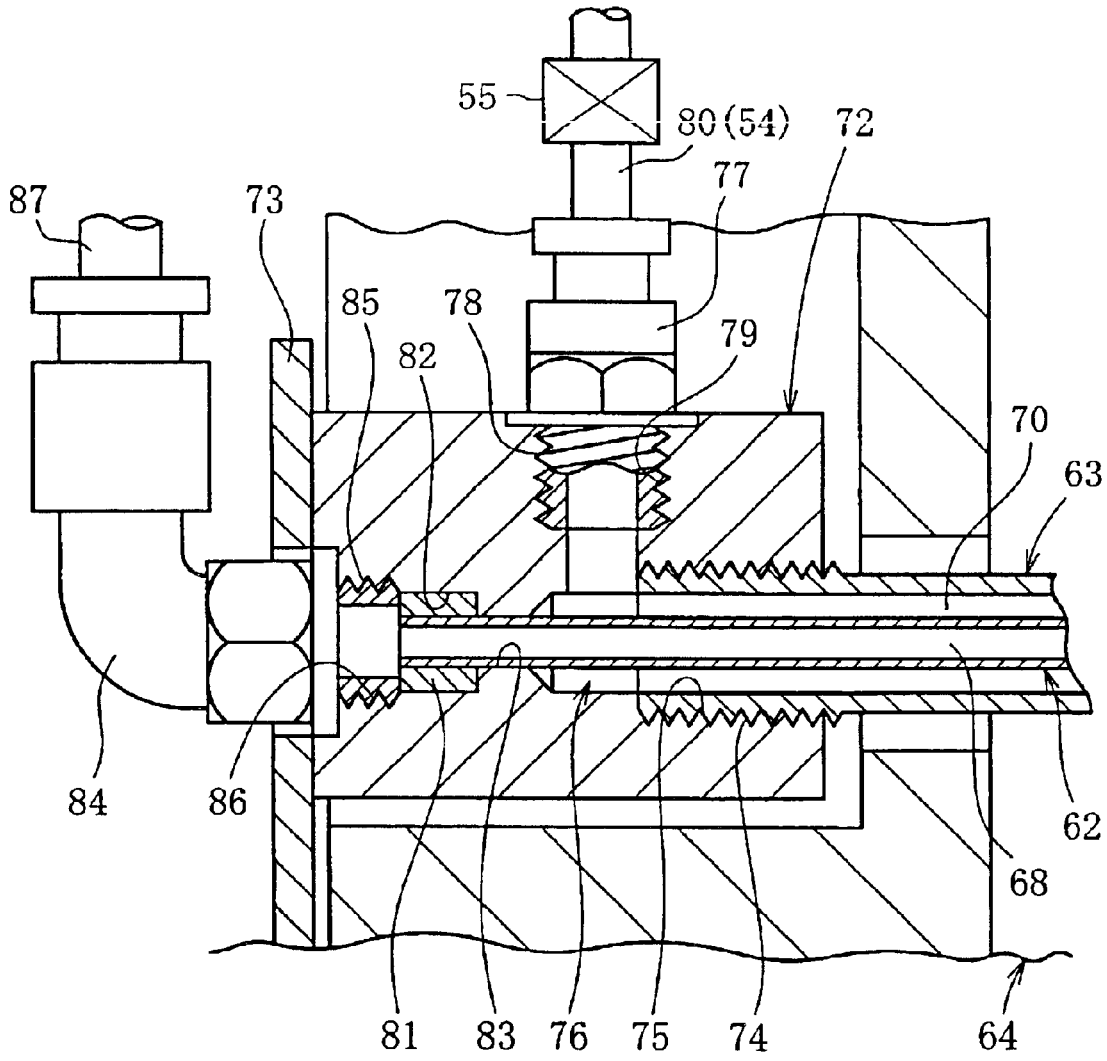
FIG. 5 is an enlarged sectional view showing the peripheral region around the base end of the fluid flow passageway in the mold.

Embodiments of the invention will now be described with reference to the drawings. FIG. 1 is a front view, in longitudinal section, showing a pump section which is a component of a mold cooling device according to a first embodiment of the invention. FIG. 2 is a schematic view showing a fluid feeding and discharging circuit which is a component of the mold cooling device. FIGS. 3, 4 and 5 are front views, in longitudinal section, showing the peripheral construction around a fluid flow passageway which is a component of the mold cooling device.

As shown in FIG. 1, the pump section 1 has a first cylinder chamber 2 and a second cylinder chamber 3 which are arranged in series on the same axis, said first and second cylinder chambers 2 and 3 having disposed therein a first piston 4 and a second piston 5, respectively, said pistons 4 and 5 being fixed to the opposite ends of a piston rod 6.

In this case, the cylinder diameter of the first cylinder chamber 2, i.e., the piston diameter of the first piston 4 is made larger than the cylinder diameter of the second cylinder chamber 3, i.e., the piston diameter of the second piston 5. In addition, the piston rod 6 is inserted in a through hole in a partition wall body 7 separating the first and second cylinder chambers 2 and 3, so that the piston rod 6 is axially slidable through a bushing (bearing) 8 and a seal member 9.

The head side (left side) and rod side (right side) of the first piston 4 in the first cylinder chamber 2 are formed with a head side air chamber 10 and a rod side air chamber 11, respectively, while the head side (right side) and rod side (left side) of the second piston 5 in the second cylinder chamber 3 are formed with a head side liquid chamber 12 and a rod side liquid chamber 13, respectively.

A first end wall body 14 sealing the head side end of the first cylinder chamber 2 is formed with a head side air inlet/outlet port 15 leading to the head side air chamber 10, and the partition wall body 7 is formed with a rod side air inlet/outlet port 16 leading to the rod side air chamber 11. Further, a second end wall body 17 sealing the head side end of the second cylinder chamber 3 is formed with a head side liquid inlet/outlet port 18 leading to the head side liquid chamber 12, and the partition wall body 7 is formed with a rod side liquid inlet/outlet port 19 leading to the rod side liquid chamber 13.

In addition, the pump section 1 is fixedly installed on a base block, floor surface or the like through brackets 20 and 21 attached respectively to the first and second end wall bodies 14 and 17 so that the axis of the pump section extends horizontally.

FIG. 2 shows by way of example a feeding and discharging circuit for air and cooling liquid in the mold cooling device. As shown in the same figure, the air feeding and discharging circuit 22 comprises a head side air passageway 23 and a rod side air passageway 24 leading respectively to the head side air inlet/outlet port 15 and rod side air inlet/outlet port 16 for the first cylinder chamber 2 in the pump section 1, a main air passageway 26 leading to an air source 25, and an air passageway switching valve 27 in the form of a solenoid valve for switching in two positions the communicating state between the head side and rod side air passageways 23, 24 and the main air passageway 26. This air passageway switching valve 27 is constructed to take a position which causes the head side air passageway 23 to communicate with the main air passageway 26 and causes the rod side air passageway 24 to open to the atmosphere, and a position (the illustrated position) which causes the rod side air passageway 24 to communicate with the main air passageway 26 and causes the head side air passageway 23 to open to the atmosphere.

The main air passageway 26 branches out into a temperature adjusting air passageway 29 leading to the mold (the mold cooling section) 28, said temperature adjusting air passageway 29 having installed somewhere between the ends thereof a temperature adjusting air opening/closing valve 30 in the form of a solenoid valve for opening and closing said passageway 29. In addition, installed upstream of the point at which the temperature adjusting air passageway 29 branches from the main air passageway 26 are an air filter 31, a first pressure reducing valve 32 for adjusting pressing force, and a pressure gauge 33, in the order from the upstream side. Further, installed downstream of the point at which the temperature adjusting air passageway 29 branches from the main air passageway 26 and upstream of the air passageway switching valve 27 is a second pressure reducing valve 34 for adjusting pressing force.

On the other hand, the cooling liquid feeding and discharging circuit 35 has a main liquid introducing passageway 37 leading to a liquid source 36 (which, in this embodiment, is a city water system) and branching somewhere in the downstream region out into a head side liquid introducing branch passageway 38 and a rod side liquid introducing branch passageway 39, and a main liquid feeding passageway 40 leading to the mold cooling section 28 and branching somewhere in the upstream region out into a head side liquid feeding branch passageway 41 and a rod side liquid feeding branch passageway 42.

And, the two head side and rod side liquid introducing branch passageways 38 and 39 have first check valves 43 and 44 installed therein for which the reverse direction is toward the liquid source 36, while the two head side and rod side liquid feeding branch passageways 41 and 42 have second check valves 45 and 46 installed therein for which the forward direction is toward the mold cooling section 28.

Further, the downstream end of the head side liquid introducing branch passageway 38 and the upstream end of the head side liquid feeding branch passageway 41 join together to communicate with the head side liquid inlet/outlet port 18, while the downstream end of the rod side liquid introducing branch passageway 39 and the upstream end of the rod side liquid feeding branch passageway 42 join together to communicate with the rod side liquid inlet/outlet port 19.

Further, the mold cooling section 28 has an air/liquid discharging passageway 54 communicatively led out therefrom, said air/liquid discharging passageway 54 having a discharge air opening/closing valve 55 installed thereon which is in the form of a solenoid valve for opening and closing said passageway 54.

In addition, a liquid filter 47 is installed in the upstream end of the main liquid introducing passageway 37. Further, the main liquid feeding passageway 40 has a liquid feeding opening/closing valve 48 installed somewhere between the ends thereof for opening and closing said passageway 40, the opening and closing times, particularly the opening time, for said liquid feeding opening/closing valve 48 being set by a timer. An auxiliary liquid passageway 50 having a variable orifice 49 installed therein branches from the upstream side of the liquid feeding opening/closing valve 48 in the main liquid feeding passageway 40, and a pressure gauge 51 and a pressure switch 52 are installed downstream of the variable orifice 49 in said auxiliary liquid passageway 50. This pressure switch 52 is adapted to generate a predetermined signal when the pressure of the cooling liquid in the main liquid feeding passageway 40, i.e., the pressure of the cooling liquid fed to the mold cooling section 28, becomes equal to or less than a predetermined value.

FIGS. 3, 4 and 5 show by way of example the detailed construction of the mold cooling section 28. In addition, in these figures, the term "front end side" refers to the right side in the figure and "base end side" refers to the left side in the figure.

As shown in FIG. 3, the mold cooling section 28 comprises coaxially disposed inner and outer pipes 62 and 63, the respective front end openings in the inner and outer pipes 62 and 63 communicating with the bottom-closed cooling hole 66 in the pin section (core pin) 65 of the mold 64. And, the front end of the inner pipe 62 opens at a position close to the bottom surface 67 present at the front end of the bottom-closed cooling hole 66, while the front end of the outer pipe 63 opens at the end position on the base end side of the bottom-closed cooling hole 66. Therefore, the inner passageway 68 of the inner pipe 62 communicates with a between-pipe passageway 70 present between the inner and outer pipes 62 and 63 through a cooling hole inner passageway 69 present between the inner pipe 62 and the bottom-closed cooling hole 66.

Figure 6:
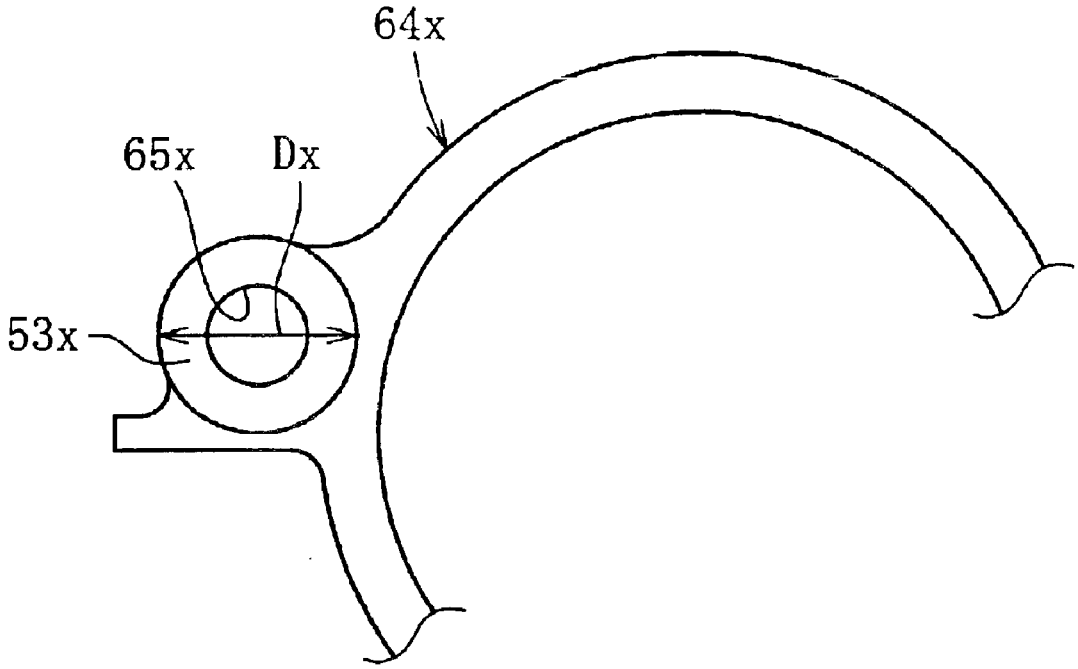
FIG. 6 is a principal front view showing an example of a cast article produced by using said mold cooling device.

And, the already-described main liquid feeding passageway 40 and the temperature adjusting air passageway 29 join the inner passageway 68 of the inner pipe 62 to communicate therewith, while the already-described air/liquid discharging passageway 54 communicates with the between-pipe passageway 70. Therefore, the fluid flow passageway 65*a* in the interior of the core pin 65 is composed of the inner passageway 68 of the inner pipe 62, cooling hole inner passageway 69, and between-pipe passageway 70. The core pin 65 is inserted in the cavity portion 53 formed in the mold 64, said cavity portion 53 cooperating with the core pin 65 to form the holed raised portion of an aluminum cast article. That is, a housing 64*x* for the aluminum cast article shown in FIG. 6 is formed by means of the whole cavity of this mold 64, and a cylindrical boss portion 53*x* in the form of a holed raised portion having a hole 65*x* is formed by means of said cavity portion 53 and core pin 65.

In this case, as shown in FIG. 3, the inner pipe 62 has its front end side and base end side respectively projecting beyond the front end surface and base end surface of the outer pipe 63. The outer periphery of the front end of the outer pipe 63 has a seal member mounted thereon which is composed of one or a plurality (two in the illustrated example) of O-rings 71, whereby the cooling hole inner passageway 69 of the bottom-closed cooling hole 66 is sealed with respect to the outside of the core pin 65.

On the other hand, as shown in FIG. 4, the bottom surface 67 of said bottom-closed cooling hole 66 is formed with a flat surface portion 67*a* in its central region of predetermined diameter (Da) on the basis of the axis (X), and its outer peripheral region is formed with a curved surface portion 67*b* continuously extending from said flat surface portion 67*a* to the inner peripheral surface 66*a* of the bottom-closed cooling hole 66. This curved surface portion 67*b* is substantially arcuate in the section shown in the same figure, i.e., in the axis-containing section, and hence the three-dimensional shape of the curved surface forms part of a spherical surface. Further, the inner peripheral surface 66*a* of the bottom-closed cooling hole 66 presents a cylindrical surface which is substantially constant in diameter from the front end to the base end.

The diameter (Da) of the flat surface portion 67*a* of said bottom surface 67 is set to be larger than the inner diameter (d) of the inner pipe 62; in this embodiment, the diameter (Da) of the flat surface portion 67*a* is about twice the inner diameter (d) of the inner pipe 62. However, if necessary, the two may be substantially equal in diameter. Further, in this embodiment, the front end of the inner pipe 62 is positioned slightly closer to the base end side than the region formed with the curved surface portion 67*b*. However, if necessary, the front end of the inner pipe 62 may be positioned somewhere between the ends of the region formed with the curved surface portion 67*b*, or the front end of the inner pipe 62 and the base end side end of the curved surface portion 67*b* may be disposed at substantially the same position.

Further, the spacing dimension (S) between the front end of the inner pipe 62 and the bottom surface 67 opposed thereto (in this embodiment, the flat surface portion 67*a*) is set at not more than five times, for example, at about twice the inner diameter (d) of the inner pipe 62. Specifically, this spacing dimension (S) is set at 2.0–5.0 mm, preferably 2.5–3.0 mm. Further, the flow channel area, $\{\pi(D^2-d1^2)/4\}$, of the cooling hole inner passageway 69 is set at 1.5–2 times the flow channel area, $\{\pi d^2/4\}$, of the inner pipe 62. In addition, the wall-thickness (t1) of the outer peripheral wall of the core pin 65 is set at 1.0–2.0 mm, and the wall-thickness (t2) of the bottom wall thereof is set at 1.0–4.0 mm. Further, the outer end surface 65*a* of the bottom wall of the core pin 65 is a flat surface.

The flow passageways for the cooling liquid in the base end side of said inner and outer pipes 62 and 63 are constructed, for example, as follows. That is, as shown in FIG. 5, the base ends of the outer and inner pipes 63 and 62 are mounted on a connecting head 72 for hose connection, said connecting head 72 abutting against a keep plate 73 installed on the base end side of the mold 64, thereby preventing the two pipes 62 and 63 from slipping off the bottom-closed cooling hole 66. The outer periphery of the base end of the outer pipe 63 is formed with a male screw thread portion 74, which is screwed into a female pipe screw thread portion 75 formed in the connecting head 72. The base end side of the portion of screw engagement with the outer pipe 63 in the connecting head 72 is formed with a liquid chamber 76 connected to the female pipe screw thread portion 75, with the inner pipe 62 extending through said liquid chamber 76.

The connecting head 72 has a straight joint 77 mounted thereon which leads to the liquid chamber 76, said straight joint 77 being formed with a male screw thread portion 78, which is screwed into a first plumbing female screw thread portion (drain port) 79 formed in the connecting head 72. And, one end of the straight joint 77 has a discharge pipe 80 removably mounted thereon, the inner passageway of this discharge pipe 80 serving as the already-described air/liquid discharge passageway 54. Further, this discharge pipe 80 has installed therein the already-described air discharge opening/closing valve 55. In addition, the first plumbing female screw thread portion 79 is formed to extend in a direction orthogonal to the axis of the two pipes 62 and 63.

The outer periphery of the base end of the inner pipe 62 has a flange 81 fixedly integrated therewith so that the inner passageway 68 opens at the base end surface, said flange 81 removably engaging, from the base end side, an engaging recess 82 formed in the connecting head 72. The portion between the liquid chamber 76 of the connecting head 72 and the engaging recess 82 is formed with an engaging hole 83 in which the inner pipe 62 is telescopically engaged in its sealed state established as by a seal member. The connecting head 72 has an L-shaped elbow joint 84 mounted thereon which leads to the base end of the inner passageway 68, said elbow joint 84 being formed with a male screw thread portion 85 which is screwed into a second plumbing female screw thread portion (water feed port) 86 formed in the connecting head 72. Further, the elbow joint 84 has a hose 87 removably mounted on one end thereof, it being arranged that the direction of connection of the hose 87 to the elbow joint 84 is parallel with the direction of connection of the discharge pipe 80 to said straight joint 77.

And, in producing a cast article (for example, a housing 64*x* shown in FIG. 6) using this mold 64, molten metal is poured into the entire cavity including the cavity portion 53 of the mold 64, and then cooling liquid and air are fed to the fluid flow passageway 65*a* of the core pin 65, the timing for feeding the cooling liquid and air being set as follows.

That is, let (D1) be the outer diameter of the core pin 65 shown in FIG. 3, (t1) be the outer peripheral thickness of the core pin 65, and (Dx) be the outer diameter-corresponding dimension of the boss portion 53*x* of the housing 64*x* shown in FIG. 6, and (T1) which is the result of the calculation $-5.103+(0.621\times Dx)-(1.068\times D1)+(3.61\times t1)$ is found. With this (T1) used as an index, the time (T) for feeding cooling liquid to the fluid flow passageway 65*a* of the core pin 65 after completion of the pouring of molten metal into the entire cavity including the cavity portion 53 is set so that $T1-0.5 \text{ seconds} \leqq T \leqq T1+0.5 \text{ seconds}$. Further, it is arranged that the feeding is stopped upon lapse of the time (T) as the cooling liquid is fed and that air is fed to the fluid flow passageway 65*a* of the core pin 65 upon lapse of 5 to 15 seconds, preferably about 10 seconds, immediately after the stoppage.

In the formula for finding the time (T1), the individual numerical values −5.103, 0.621, 1.068 and 3.61 are values obtained by us conducting experiments on feeding cooling liquid and air many times with respect to many kinds of boss portions 53*x* having (Dx) and many kinds of core pins 65 having (D1) and (t1), sampling cooling liquid feeding times with respect to said many kinds of boss portions 53*x* and many kinds of core pins 65 so as to find a high-quality boss portion 53*x* and a temperature which is optimum for the outer surface of the core pin 65 to have a releasing agent applied thereto, and performing predetermined calculations on the basis of such cooling liquid feeding times, and respective values of (Dx), (D1) and (t1).

In the mold cooling section 28, it is arranged that after the cooling liquid fed from the elbow joint 84 to the inner passageway 68 of the inner pipe 62 has been discharged through the front end opening in the inner pipe 62 to reach a region in the vicinity of the bottom surface 67 of the bottom-closed cooling hole 66, it passes through the cooling hole inner passageway 69 and between-pipe passageway 70 present on the outer periphery side of the inner pipe 62, reaching the liquid chamber 76, then flowing out through the straight joint 77. Further, it is arranged that after the air fed from the elbow joint 84 to the inner passageway 68 of the inner pipe 62 has flowed through the same course as that for said cooling liquid, it flows out through the straight joint 77.

According to the above arrangement, the air passageway switching valve 27 of the air feeding and discharging circuit 22 is alternately switched at a predetermined period between a position shown in FIG. 2 and another position, whereby the first and second pistons 4 and 5 are reciprocated so that the cooling liquid fed from the liquid source 36 to the second cylinder chamber 3 is fed to the mold cooling section 28 side (fluid flow passageway 65*a* side of the mold 64).

To describe in more detail, in the case where the air passageway switching valve 27 is switched from the position shown in FIG. 2 to another position, the pressurized air led from the air source 25 into the main air passageway 26 flows from the head side air passageway 23 into the head side air chamber 10 of the first cylinder chamber 2, while the rod side air chamber 11 becomes open to the atmosphere through the rod side air passageway 24. This moves the first and second pistons 4 and 5 forward (to the right), delivering the cooling liquid from the head side liquid chamber 12 of the second cylinder chamber 3 into the main liquid feeding passageway 40 through the head side liquid feeding branch passageway 41. In addition, the cooling liquid tending to flow from the head side liquid chamber 12 to the head side liquid introducing branch passageway 38 is prevented from so flowing by the first check valve 43.

Further, in the case where the first and second pistons 4 and 5 move forward in this manner, the cooling liquid flowing into the main liquid introducing passageway 37 from the liquid source 36 is drawn into the rod side liquid chamber 13 of the second cylinder chamber 3 via the rod side liquid introducing branch passageway 39. In this case, the cooling liquid tending to flow back through the rod side liquid feeding branch passageway 42 from the mold cooling section 28 via the main liquid feeding passageway 40 is prevented from flowing back by the second check valve 46.

On the other hand, in the case where the first and second pistons 4 and 5 reach the end of forward movement to switch the air passageway switching valve 27 to the position shown in FIG. 2, the pressurized air led from the air source 25 into the main air passageway 26 flows from the rod side air passageway 24 into the rod side air chamber 11 of the first cylinder chamber 2, while the head side air chamber 10 becomes open to the atmosphere through the head side air passageway 23. This causes the first and second pistons 4 and 5 to move backward (leftward movement), delivering the cooling liquid from the rod side liquid chamber 13 of the second cylinder chamber 3 to the main liquid feeding passageway 40 through the rod side liquid feeding branch passageway 42. In addition, the cooling liquid tending to flow from the rod side liquid chamber 13 to the rod side liquid introducing branch passageway 39 is prevented from so flowing by the first check valve 44.

Further, in the case where the first and second pistons 4 and 5 move backward in this manner, the cooling liquid flowing from the liquid source 36 into the main liquid introducing passageway 37 is drawn into the head side liquid chamber 12 of the second cylinder chamber 3 via the head side liquid introducing branch passageway 38. In this case, the cooling liquid tending to flow back through the head side liquid feeding branch passageway 41 from the mold cooling section 28 via the main liquid feeding passageway 40 is prevented from flowing back by the second check valve 45.

The operations described above are repetitively performed, whereby the cooling liquid is fed from the second cylinder chamber 3 to the main liquid feeding passageway 40 whenever the first and second pistons 4 and 5 are moved forward or backward. This ensures that the operation of feeding the cooling liquid to the mold cooling section 28 is continuously effected, with no loss in the feeding of the cooling liquid, so that a sufficient amount of cooling liquid is fed to the mold cooling section 28.

The result of measurement of the performance of the pump section of the mold cooling device according to this embodiment is as shown in the following paragraphs (1) through (4). In addition, in the pump section used in the measurement, the piston diameter of the second piston 5 is 100 mm and the amount of delivery of water (cooling liquid) per reciprocation is 3.15 liters.

(1) For 1 second of operation, the number of reciprocating movements of the second piston 5 is 0.2, and the consumption of tap water is 0.6 liters.

(2) For 10 seconds of operation: the number of reciprocating movements of the second piston 5 is 2, and the consumption of tap water is 6.3 liters.

(3) For 30 seconds of operation: the number of reciprocating movements of the second piston 5 is 6, and the consumption of tap water is 19 liters.

(4) For 60 seconds of operation: the number of reciprocating movements of the second piston 5 is 12.4, and the consumption of tap water is 40 liters.

In this case, the liquid feeding opening/closing valve 48 in the main liquid feeding passageway 40 is opened upon lapse of about 0.5 second after the start of the pouring of molten metal into the entire cavity of the mold 64, that is, it is opened upon lapse of predetermined time with consideration given to safety after completion of the pouring of molten metal, whereby the cooling liquid is fed to the fluid flow passageway 65*a* of the mold 64.

During the feeding of the cooling liquid, the cooling liquid passing through the inner passageway (forward passageway) 68 of the inner pipe 62 from the elbow joint 84 shown in FIG. 5 is delivered from the front end opening in the inner pipe 62 and reaches a region in the vicinity of the bottom surface 67 of the bottom-closed cooling hole 66, then passing through the cooling hole inner passageway 69 present on the outer periphery of the inner pipe 62 and through the between-pipe passageway (backward passageway) 70 between the two pipes 2 and 3 to reach the liquid chamber 76, from which it flows out through the straight joint 77.

In the case where the cooling liquid is delivered to the bottom surface 67 of the bottom-closed cooling hole 66 through the front end opening in the inner pipe 62 during such circulation of the cooling liquid, the formation of the flat surface portion 67*a* in the central region of the bottom surface 67 causes the cooling liquid whose direction of flow has changed as it collides with the flat surface portion 67*a* to have a lot of its flow component to diffuse toward the outer periphery, without converging around the axis (X) as in the prior art. And, the cooling liquid flowing along the bottom surface 67 toward the outer periphery smoothly changes its direction at the curved surface portion 67*b* of the outer peripheral region to flow through the cooling hole inner passageway 69 in a direction parallel with the axis (X) and away from the bottom surface 67, then flowing out through the between-pipe passageway 70. In the bottom-closed cooling hole 66, such flow of the cooling liquid is the main flow, so that interference with passage of the cooling liquid or consequent stagnation hardly occurs in the vicinity of the bottom surface 67, ensuring sufficient cooling action to avoid drawbacks including the welding of the diecast article in the cavity portion 53 to the mold 64 (core pin 65).

Further, since the dimension (S) of the spacing between the bottom surface 67 of the bottom-closed cooling hole 66 and the front end of the inner pipe 62 is set at a smaller value than in the prior art, the cooling liquid delivered from the front end opening in the inner pipe 62 collides with the bottom surface 67 of the bottom-closed cooling hole 66 without involving insufficient flow speed, subsequent fresh cooling liquid always present in the vicinity of the bottom surface 67. Therefore, this also minimizes the stagnation of the cooling liquid in the vicinity 53 of the bottom surface 67 to ensure sufficient cooling action, thus avoiding drawbacks including the welding of the diecast article to the mold 64.

Furthermore, the flow channel area of the cooling hole inner passageway 69 is set at 1.5–2 times the flow channel area of the inner pipe 62, whereby while preventing a buildup of flow resistance of the cooling liquid passing through the cooling hole inner passageway 69, sufficient flow speed of the cooling liquid can be secured to ensure satisfactory passage of cooling liquid throughout the fluid flow passageway 65*a*.

And, in the step where such operation is being performed, said liquid feeding opening/closing valve 48 is closed said (T1) seconds or (T1+0.5) seconds after the opening of the valve, thereby stopping the feeding of cooling liquid to the fluid flow passageway 65*a* of the mold 64.

On the other hand, the temperature adjusting air opening/closing valve 30 in the temperature adjusting air passageway 29 opens immediately after or at substantially the same time as the closing of the liquid feeding opening/closing valve 48, thereby feeding air to the fluid flow passageway 65*a* of the mold 64. And, the temperature adjusting opening/closing valve 30 closes upon lapse of 5 to 15 seconds, preferably about 10 seconds, after valve opening, thereby stopping the feeding of air to the fluid flow passageway 65*a* of the mold 64.

Figure 7:
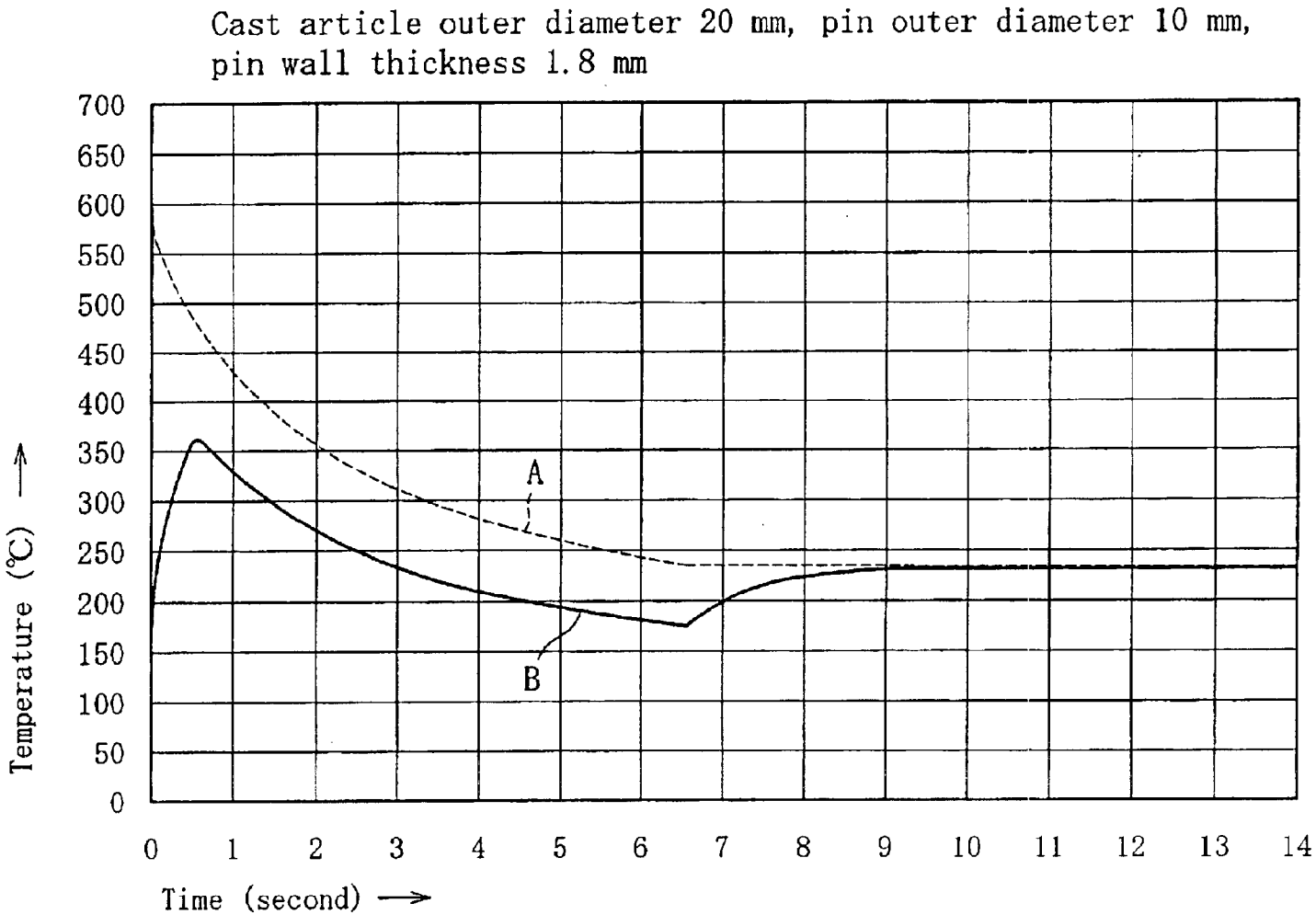
FIG. 7 is a graph showing temperature change with time in the peripheral region around said fluid flow passageway.

Next, the operation of feeding cooling liquid and air to the fluid flow passageway 65*a* of the mold 64 as described above will be explained on the basis of the graph shown in FIG. 7. In addition, the curve (A) shown in dotted line in this graph indicates the time-varying temperature of the inner surface of the hole 65*x* in the holed raised portion (boss portion 53*x*) of the cast article, and the curve (B) shown in solid line indicates the time-varying temperature of the outer surface of the pin section (core pin 65). Further, this graph shows the temperature characteristics in the case where the outer diameter-corresponding dimension (Dx) of the boss portion 53*x* is 20 mm and the outer diameter (D1) and outer peripheral wall thickness (t1) of the core pin 65 are 10 mm and 1.8 mm, respectively.

As shown in this graph, with the pouring of molten metal into the entire cavity including the cavity portion 53 of the mold 64 being taken to be started at 0 second, the cooling liquid is fed to the fluid flow passageway 65*a* upon lapse of about 0.5 second, and from this point of time onward does the outer surface temperature of the core pine 65 gradually decrease, while at substantially the same gradient does the inner surface temperature of the hole 65*x* in the boss portion 53*x* gradually decrease. At this temperature decreasing stage, the inner surface temperature of the hole 65*x* in the boss portion 53*x* is higher than the outer surface temperature of the core pin 65, with a considerable temperature difference (about 80° C., in the illustrated example).

The feeding of this cooling liquid is stopped upon lapse of (T1) calculated by the formula described above, i.e., about 6.24 seconds after the start of feeding, an immediately after stoppage, air is fed to the fluid flow passageway 65*a*. As a result, owing to recuperative action of air being effected in the fluid flow passageway 65*a*, the inner surface temperature of the hole 65*x* which has been gradually decreasing becomes stabilized at about 230° C., and the temperature decrease with time no longer takes place, while the outer surface temperature of the core pin 65 which has also been gradually decreasing rises to become substantially equal to the inner surface temperature of the hole 65*x*, the temperature becoming stabilized at about 230° C. The feeding of air is effected for about ten seconds, and then the mold is opened.

This mold opening is followed by application of a mold release agent, which is a viscous fluid, to the outer surface of the core pin 65. If the outer surface temperature of the core pin 65 is about 230° C., then a suitable amount of mold release agent adheres to the outer surface of the core pin 65, so that the next casting operation is appropriately performed.

Further, each time one lot of casting operation is performed or once in several lots of casting operation, said feeding of air to the fluid flow passageway 65*a* is effected for a predetermined time, (desirably after the mold opening), whereupon the air discharge opening/closing valve 55 in the air/liquid discharging passageway 54 is closed while air is being fed. This makes it possible to know whether air is leaking from the fluid flow passageway 65*a*, that is, whether damage, such as crack, is caused to the core pin 65.

In addition, in the first embodiment described above, the core pin 65 serving as the pin section which is a component of the mold 64 has been constructed to be separate from the mold main body; however, the core pin 65 may be a pin section which is integral with the mold main body.

Figure 8:
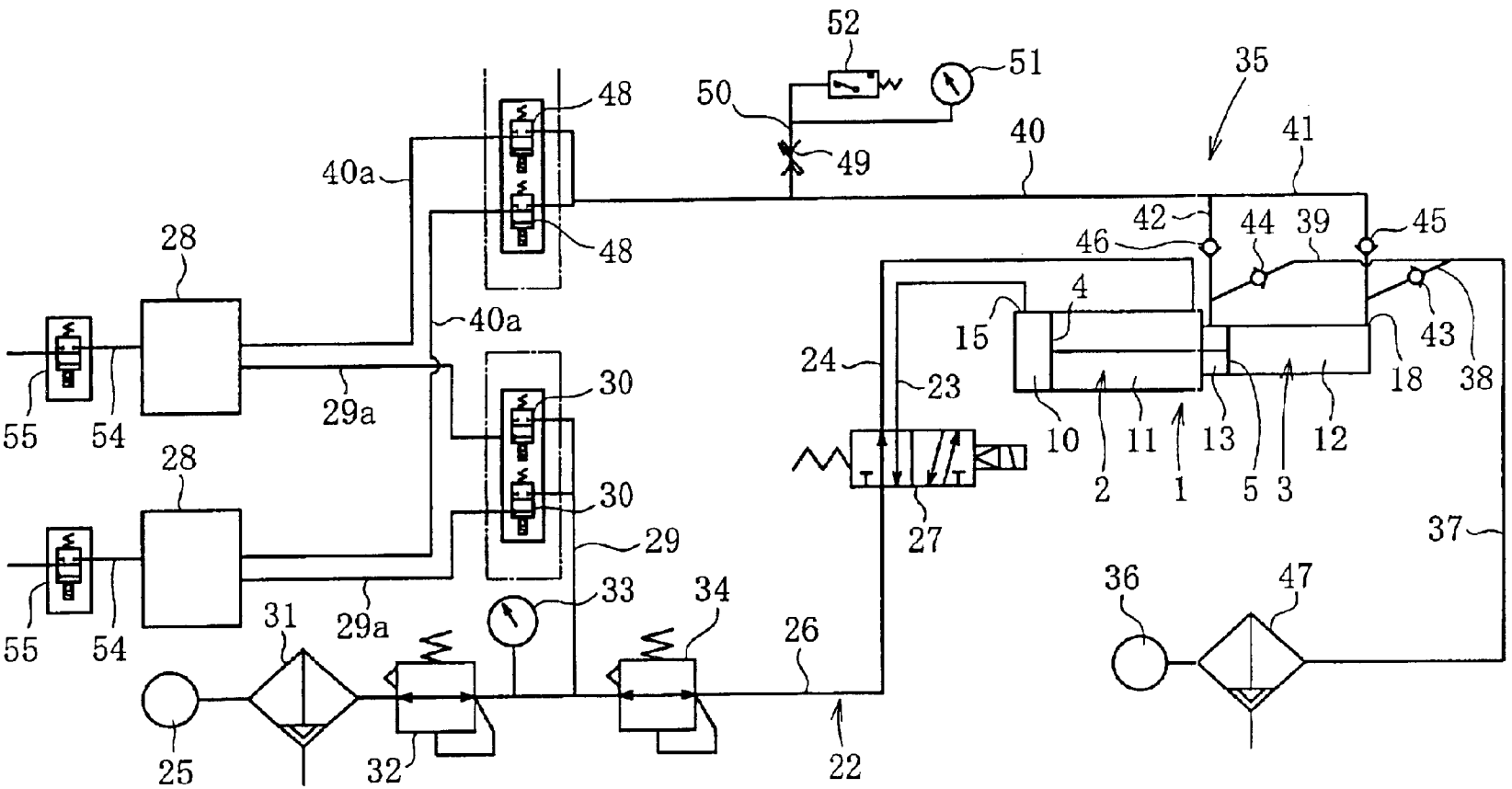
FIG. 8 is a circuit diagram showing an air feeding and discharging circuit and a cooling liquid feeding and discharging circuit in a mold cooling device according to a second embodiment of the invention.
Figure 9:
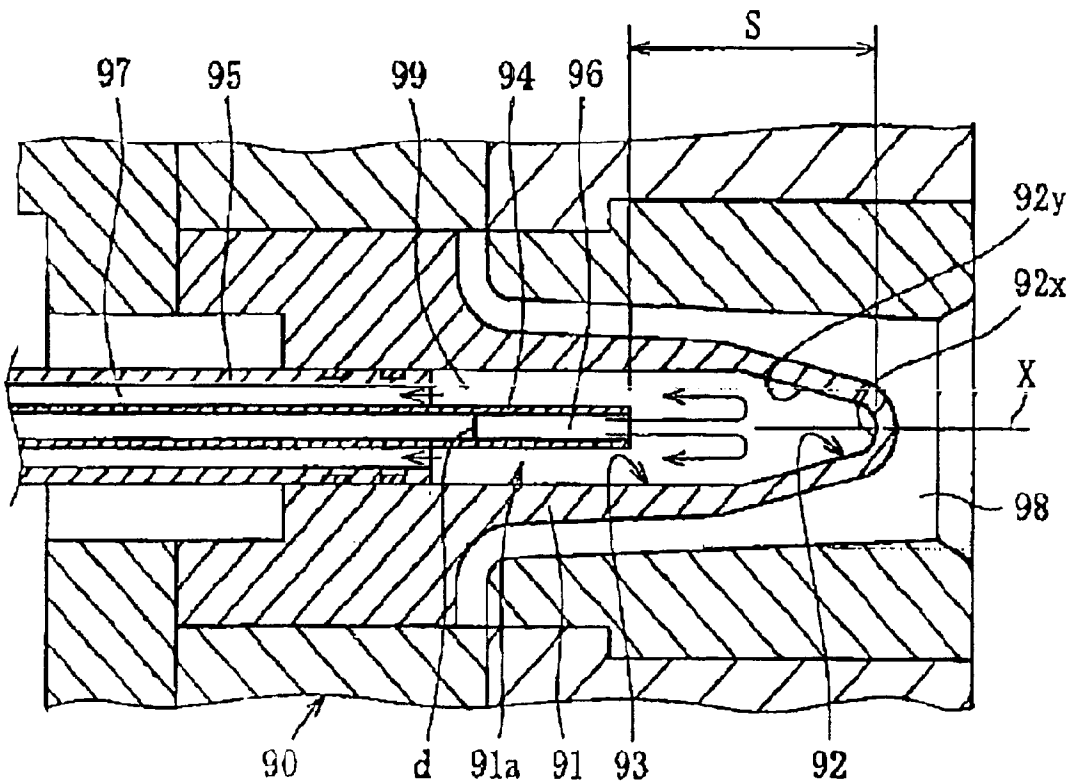
FIG. 9 (PRIOR ART)
FIG. 9 is a sectional view showing a conventional mold cooling device, particularly showing the peripheral region around the fluid flow passageway therein.

FIG. 8 shows byway of example a mold cooling device according to second embodiment of the invention. In the second embodiment, what differs from the first embodiment are that the main liquid feeding passageway 40 branches downstream of the branch point of the auxiliary liquid passageway 50 to form two main liquid feeding branch passageways 40*a* whose respective downstream ends communicate with two mold cooling sections 28, and that the temperature adjusting air passageway 29 branches to form two auxiliary air branch passageways 29*a* whose respective downstream ends communicate with the two mold cooling sections 28. In this case, the downstream end of main liquid feeding branch passageway 40*a* and the downstream end of the auxiliary air branch passageway 29*a* join each other and communicate with the fluid flow passageway 65*a* of the mold cooling section 28. In addition, those components in FIG. 7 which are in common with the embodiment shown in FIG. 2 described above are denoted by the same reference characters as those used therein so as to omit a description thereof.

According to this second embodiment, cooling liquid is fed from a single pump section 1 to two mold cooling sections 28 to achieve an effective use of the pump function. In addition, the main liquid feeding branch passageways 40*a* and auxiliary air branch passageways 29*a* may be three or more in number, respectively.

What is claimed is:

1. A mold cooling device having a pump section for feeding a cooling liquid to a fluid flow passageway formed in a mold, comprising:

an air feeding and discharging circuit which effects the driving of said pump section by air via forward and backward movements of a piston of the pump section and the feeding of air to said fluid passageway, the arrangement being such that the cooling liquid can be continuously fed from said pump section to said fluid flow passageway because of the forward and backward movements of the piston.

2. A mold cooling device, having a pump section for feeding a cooling liquid to a fluid flow passageway formed in a mold, comprising:

an air feeding and discharging circuit which effects the driving of said pump section by air and the feeding of air to said fluid passageway, the arrangement being such that the cooling liquid can be continuously fed from said pump section to said fluid flow passageway, wherein said pump section comprises a first cylinder chamber and a second cylinder chamber which are coaxially arranged in series, a first piston and a second piston which are disposed in said first and second cylinder chambers, respectively, and a piston rod for connecting said two pistons to each other, wherein during both periods of forward and backward movements of both said pistons attending on the feeding and discharging of air to and from said first cylinder chamber, the cooling liquid is fed from said second cylinder chamber to the fluid flow passageway of said mold.

3. A mold cooling device as set forth in claim 1, wherein said mold is designed to form the holed convex portion of a cast article between the pin section having said fluid flow passageway formed therein and the cavity portion surrounding the outer periphery of said pin section, and the temperature adjustment of the outer surface of said pin section and the hole inner surface of the holed convex portion contacting the same is made on the basis of (1) the feeding of cooling liquid to said fluid flow passageway and (2) the recuperative action which is consequent on the feeding of air to said fluid flow passageway immediately after stoppage of said feeding of cooling liquid.

4. A mold cooling device as set forth in claim 3, wherein letting (D1) be the outer diameter of said pin section, (t1) be the outer peripheral thickness of said pin section, and (Dx) be the outer diameter-corresponding dimension of the holed convex portion of said cast article, (T1) be $-5.103\times(0.621\times Dx)-(1.068\times D1)+(3.61\times t1)$, the time (T) for feeding cooling liquid to the fluid flow passageway after completion of the pouring of molten metal into said mold is set so that the relation $T1-0.5$ seconds $\leqq T \leqq T1+0.5$ seconds is satisfied.

5. A mold cooling device as set forth in claim 4, wherein immediately after the stoppage of the feeding of cooling liquid to said fluid flow passageway, air is fed to said fluid flow passageway for 5 seconds or more.

6. A mold cooling device as set forth in claim 5, wherein the feeding of air to said fluid flow passageway causes the outer surface temperature of said pin section to terminate within the temperature range of 200–2500° C.

7. A mold cooling device as set forth in claim 3, wherein an opening/closing valve for opening/closing a discharge passageway is installed in the discharge passageway for air from said fluid flow passageway, wherein the discharge passageway is communicatively led out from a cooling section of the mold cooling device.

8. A mold cooling device as set forth in claim 1, wherein said fluid flow passageway is constructed in such a manner that concentrically arranged inner and outer pipes are corrected to a bottom-closed cooling hole, which is formed in the mold to have a bottom surface on the front end, so that the front end opening in the inner pipe lies closer to said bottom surface than does the front end opening in the outer pipe, the inner passageway of said inner pipe serving as a forward passageway for cooling liquid, the between-pipe passageway between both said pipes serving as a backward passageway for cooling liquid, the central region of the bottom of the surface of said bottom-closed cooling hole being formed with a flat surface portion, whose outer peripheral region is formed with a curved surface portion which continuously extends from said flat surface portion to the inner peripheral surface of the bottom-closed cooling hole.

9. A mold cooling device as set forth in claim 8, wherein the diameter of said flat surface portion is set at a larger value than the inner diameter of said inner pipe.

10. A cooling device as set forth in claim 8, wherein said curved surface portion exhibits a substantially arcuate shape in its axis-containing sections.

11. A mold cooling device having a pump section for feeding a cooling liquid to a fluid flow passageway fanned in a mold, comprising:

an air feeding and discharging circuit which effects the driving of said pump section by air and the feeding of air to said fluid passageway, the arrangement being such that the cooling liquid can be continuously fed from said pump, section to said fluid flow passageway, wherein said fluid flow passageway is constructed in such a manner that concentrically arranged inner and outer pipes are connected to a bottom-closed cooling hole, which is formed in the mold to have a bottom surface on the front end, so that the front end opening in the inner pipe lies closer to said bottom surface than does the front end opening in the outer pipe, the inner passageway of said inner pipe serving as a forward passageway for cooling liquid, the between-pipe passageway between both said pipes serving as a backward passageway for cooling liquid, spacing dimension between the bottom surface of said bottom-closed cooling hole and the front end of said inner pipe being set at not more than 5 times the inner diameter of said inner pipe.

12. A mold cooling device as set forth in claim 11, wherein the spacing dimension between the bottom surface of said bottom-closed cooling hole and the front end of said inner pipe is set at 2.0–5.0 mm.

13. A mold cooling device as set forth in claim 11, wherein the flow channel area of the cooling hole inner passageway, which is formed between the inner peripheral surface of said bottom-closed cooling hole and the outer peripheral surface of said inner pipe, is set at 1.5–2 times the flow channel area of said inner pipe.

* * * * *